US006984134B1

(12) United States Patent
Eakins et al.

(10) Patent No.: US 6,984,134 B1
(45) Date of Patent: Jan. 10, 2006

(54) TERMINAL CONNECTOR

(75) Inventors: Bert Eakins, Ortonville, MI (US); Paul R. Glei, Allen Park, MI (US); Camilla A. Sienkiewicz, Harrison Township, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/868,995

(22) Filed: Jun. 16, 2004

(51) Int. Cl.
*H01R 12/00* (2006.01)

(52) U.S. Cl. ..... 439/78

(58) Field of Classification Search ..... 439/78, 439/74, 75, 857, 853
See application file for complete search history.

(56) References Cited

U.S. PATENT DOCUMENTS 3,270,251 A * 8/1966 Evans ..... 361/729
4,356,469 A 10/1982 Dozier
4,797,113 A * 1/1989 Lambert ..... 439/74
5,403,199 A 4/1995 Mobley et al.
5,458,502 A 10/1995 Joly
5,647,748 A * 7/1997 Mills et al. ..... 439/81
6,354,890 B2 3/2002 Adkins et al.
6,524,117 B1 * 2/2003 Murakami et al. ..... 439/74
6,679,708 B1 1/2004 Depp et al.
6,692,316 B2 2/2004 Hsieh et al.

* cited by examiner

*Primary Examiner*—Phuong Dinh
(74) *Attorney, Agent, or Firm*—MacMillan, Sobanski & Todd, LLC

(57) ABSTRACT

A terminal blade connection system has a first printed circuit board including a blade passage extending therethrough. Also, a receptacle terminal has a first terminal support leg, a second terminal support leg, spaced from the first terminal support leg, and a side support arm connected between the first and second terminal support legs, with the first terminal support leg mounted on one side of the blade passage and the second terminal support leg mounted on the other side of the blade passage, and with the two support legs forming a contact portion. The contact portion is engagable with a terminal blade mounted on a second printed circuit board. The receptacle terminal is shaped to accept the terminal blade from either the top or the bottom, through the blade passage, thus allowing for mounting of the second printed circuit board on either side of the first.

7 Claims, 2 Drawing Sheets

TERMINAL CONNECTOR

BACKGROUND OF INVENTION

The present invention relates to electrical terminals, and in particular terminal blade connection systems.

It is known in the automotive industry to provide terminal and connector assemblies for distributing electrical current to various devices in the vehicle. Moreover, as vehicles employ more devices, which results in an even greater demand for electrical current, a need has arisen to provide multiple high current connections, in addition to low current connections. It is preferable that the connections, both high and low current, are provided in close proximity to one another. In order to accomplish this, some employ custom hybrid header connectors, which allow for the mixing of the high and low current connections. But these custom connectors are not desirable because of their relatively high cost.

Moreover, with these types of header connections, the routing on the printed circuit board must be from the high current connections to the high current header, whether the particular routings are convenient or not. This severely limits the ability to optimize a layout of a printed circuit board for routability.

Additionally, the existing printed circuit board and connector combinations are unidirectional. That is, the connection from the high current printed circuit board only allows for it to be oriented on one specific side of the low current printed circuit board. Additional flexibility can be provided if the mating between the boards could take place from either side.

Thus, it is desirable to have a connection system that can be employed to make both high and low current connections and that overcomes the drawbacks of the prior art.

SUMMARY OF INVENTION

In its embodiments, the present invention contemplates a terminal blade connection system. The terminal blade system has a first printed circuit board including a first terminal mounting passage, a second terminal mounting passage, spaced from the first terminal mounting passage, and a blade passage, located between the first and second terminal mounting passages and extending through the first printed circuit board. The terminal blade system also preferably includes a receptacle terminal having a first terminal support leg, a second terminal support leg, spaced from the first terminal support leg, and a side support arm connected between the first and second terminal support legs, with the first terminal support leg including a first foot portion mounted to the first terminal mounting passage, a first upper end spaced from the first foot portion, and a first contact portion located between the first foot portion and the first upper end, and the second terminal support leg including a second foot portion mounted to the second terminal mounting passage, a second upper end spaced from the second foot portion, and a second contact portion located between the second foot portion and the second upper end, and with the first contact portion being a distance from the second contact portion that is less than a distance between the first foot portion and the second foot portion and less than a distance between the first upper end and the second upper end.

An advantage of the present invention is that high and low current connections can be made without requiring the use of custom hybrid header connectors.

A further advantage of an embodiment of the present invention is that the blade insertion into receptacle terminals mounted on a printed circuit board can be achieved from either top side or bottom side blade entry.

An additional advantage of an embodiment of the present invention is that the different blade widths for high current blade connections and low current blade connections can be achieved with essentially the same design of receptacle terminals by employing a single receptacle terminal for the low current connections and a pair of side-by-side receptacle terminals for the high current connections.

Another advantage of an embodiment of the present invention is that the high and low current receptacle terminals can be located as desired on the printed circuit board, thus allowing for optimization of the design for routability of conductors on the printed circuit board.

DETAILED DESCRIPTION

Figure 1:
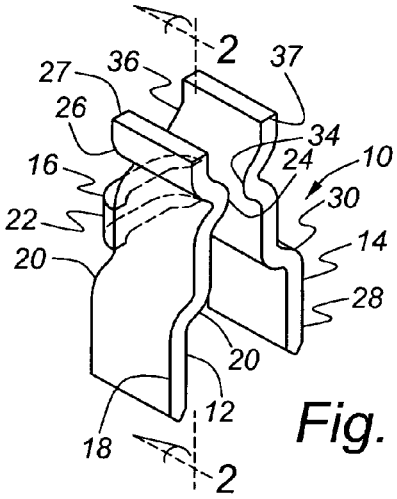
FIG. 1 is a perspective view of a receptacle terminal, in accordance with an embodiment of the present invention.
Figure 2:
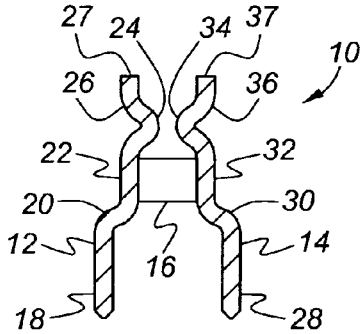
FIG. 2 is a cross sectional view of the receptacle terminal, taken along line 2—2 in FIG. 1.

FIGS. 1 and 2 illustrate a receptacle terminal, indicated generally at 10, which includes a first terminal support leg 12 and a second terminal support leg 14 connected together by a side support arm 16. Preferably, the receptacle terminal 10 is formed from a single piece of stamped metal, although it can be formed in other ways if so desired.

The first terminal support leg 12 has a first foot portion 18, which is designed to be mounted to a circuit board, discussed below. The first terminal support leg 12 also has a first bottom guide portion 20, adjacent to the first foot portion 18, a first arm support portion 22, adjacent to the first bottom guide portion 20, a first contact portion 24, adjacent to the first arm support portion 22, and a first top guide portion 26, which is adjacent to the first contact portion 24.

The second terminal support leg 14 has a second foot portion 28, which is also designed to be mounted to a circuit board, discussed below. The second terminal support leg 14 also has a second bottom guide portion 30, adjacent to the second foot portion 28, a second arm support portion 32, adjacent to the second bottom guide portion 30, a second contact portion 34, adjacent to the second arm support portion 32, and a second top guide portion 36, which is adjacent to the second contact portion 34.

The first and second bottom guide portions 20, 30 are spaced farther apart next to the foot portions 18, 28 and taper inward toward each other near the arm support portions 22, 32, which, in turn, taper inward toward each other near the contact portions 24, 34. By starting wide and tapering to narrow, the receptacle terminal 10 allows for misalignments due to tolerances in locating the receptacle terminal 10 or a terminal blade (discussed below) on a circuit board while guiding a terminal blade from under the circuit board into the narrow opening between the contact portions 24, 34. Likewise, the first and second top guide portions 26, 36 are spaced farther apart at their upper ends 27, 37, respectively, and taper inward toward each other near the contact portions 24, 34. Again, misalignments during assembly are accounted for—but this time for instances where a terminal blade is inserted into the terminal receptacle 10 from above the board, rather than below.

The side support arm 16 is sized and shaped so that the contact portions 24, 34 are spaced from each other a desired distance that is less than the thickness of the terminal blade to be inserted therein. In this way, during assembly of a terminal blade to its corresponding receptacle terminal 10, the interference fit created between the terminal blade and the contact portions 24, 34 will cause the arm 16 and terminal support legs 12, 14 to flex somewhat. This elastic flexing of the receptacle terminal 10 will create a spring-like bias of the contact portions 24, 34 against a terminal blade, thus assuring a good electrical contact is maintained.

Figure 3:
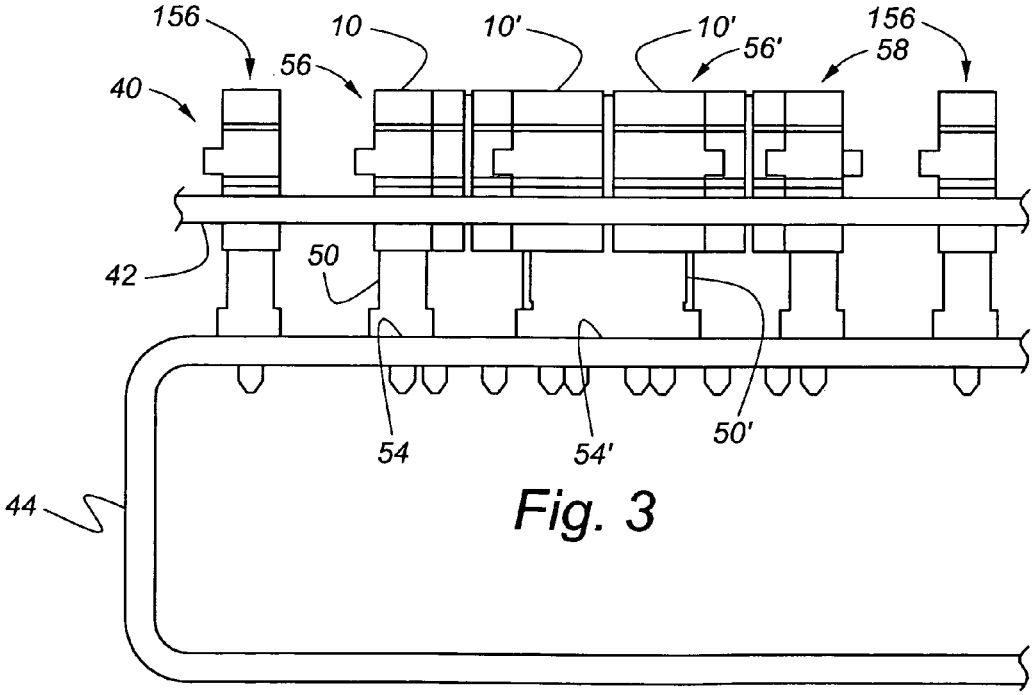
FIG. 3 is a partial elevation view of a pair of printed circuit boards assembled together with blades and receptacle terminals, in accordance with the present invention.
Figure 4:
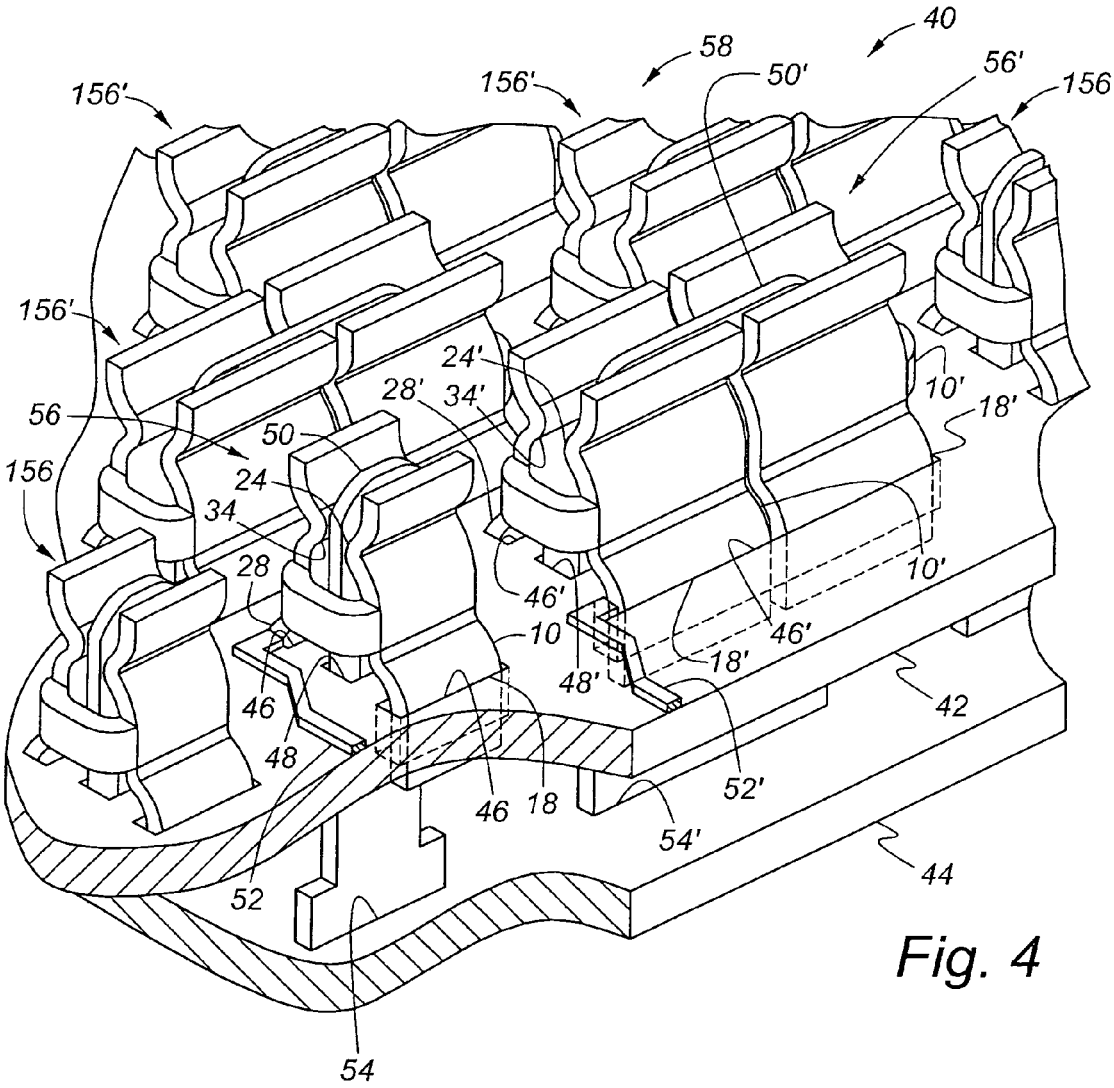
FIG. 4 is a partial perspective view, on an enlarged scale, of a portion of the assembly of FIG. 3.

FIGS. 3 and 4 illustrate an assembly, indicated generally at 40, of a first printed circuit board 42 with a second printed circuit board 44. The first printed circuit board 42 includes several receptacle terminals, including the receptacle terminal 10 illustrated in FIGS. 1 and 2, as well as first and second receptacle terminals 10' located on the first board 42 for a high current application.

The first printed circuit board 44 also includes a number of passages for mounting and receiving the various components. A pair of low current terminal mounting passages 46 extend through the first board 42 and receive the first and second foot portions 18, 28. The foot portions 18, 28 are secured to the first board 42 via these passages 46 with solder (not shown) or other conventional means. A low current blade passage 48 extends through the first board 42 about mid-way between the low current terminal mounting passages 46. The blade passage 48 has a width and length that is larger than the width and length of a low current terminal blade 50 in order to assure that the blade passage 48 will not interfere with the terminal blade 50 when inserted therethrough and into contact with the contact portions 24, 34 of the receptacle terminal 10. The receptacle terminal 10 and terminal blade 50 together form a terminal blade assembly 56. A conductive trace 52 is routed from the second (or first) foot portion 28 to a desired location (not shown) on the first board 42.

The first printed circuit board 44 also includes a pair of high current terminal mounting passages 46'. These high current terminal mounting passages 46' are significantly wider than the low current terminal mounting passages 46 because they are sized to receive the first and second foot portions 18', 28' of a pair of side-by-side receptacle terminals 10'. Again, the foot portions 18', 28' are secured to the first board 42 via these passages 46' with solder (not shown) or other conventional means. As an alternative, the first and second foot portions can have smaller sections (not shown) at their bottom ends, with shoulders adjacent thereto. The smaller sections will then slide into correspondingly smaller mounting passages until the shoulders abut the surface of the board.

A high current blade passage 48' extends through the first board 42 about mid-way between the high current terminal mounting passages 46'. The blade passage 48' has a width and length that is larger than the width and length of a high current terminal blade 50' in order to assure that the blade passage 48' will not interfere with the terminal blade 50' when inserted therethrough and into contact with the contact portions 24', 34' of the pair of receptacle terminals 10'. The receptacle terminal 10' and terminal blade 50' together form a terminal blade assembly 56'. A conductive trace 52' is routed from the first (or second) foot portion 18' to a desired location (not shown) on the first board 42.

One will note that the terminal blade 50' is much wider than the terminal blade 50, with a much greater contact area with the two receptacle terminals 10' than the terminal blade 50 has with the one receptacle terminal 10. Consequently, terminal blade 50' and receptacle terminals 10' (that is, the terminal blade assembly 56') better allow for high current flow. Yet, each of the receptacle terminals 10' are very similar to (and in some applications may be exactly the same as) the receptacle terminal 10.

The second printed circuit board 44 includes a mounting location 54 for the low current terminal blade 50 and another mounting location 54' for the high current terminal blade 50', with each being located and oriented to mate with its respective receptacle terminal 10, 10'. Each of the terminal blades 50, 50' is secured to the second board 44 at these mounting locations 54, 54' with solder (not shown) or other conventional means, with conductive traces (not shown) extending therefrom in a conventional manner.

As can be seen in FIGS. 3 and 4, multiple other terminal blade assemblies 156, 156' that are very similar to or exactly the same as the terminal blade assemblies 56, 56', respectively, can be located on the first and second printed circuit boards 42, 44 as needed for the particular application.

Since each terminal blade assembly 56, 56', 156, 156' is a stand alone structure, the high and low current terminal connections can generally be located on the first and second printed circuit boards 42, 44 wherever is desirable for optimizing routability of the conductive traces 52, 52', thus being easily adapted for different applications. For example, if so desired, one can employ these terminal blade assemblies in an application with all high current connections. Moreover, each terminal blade assembly 56, 56', 156, 156', whether adapted for low current or high current, allows for bottom or top side mating terminal blade entry. Since the blades 50, 50' can be inserted from either direction, one has a choice of which side to locate the first printed circuit board 42 relative to the second printed circuit board 44 when laying out the boards 42, 44 for a particular application. The result is a much improved terminal blade connection system 58 for making the connections between a first printed circuit board 42 to a second printed circuit board 44.

While certain embodiments of the present invention have been described in detail, those familiar with the art to which this invention relates will recognize various alternative designs and embodiments for practicing the invention as defined by the following claims.

What is claimed is:

1. A terminal blade connection system comprising:

a first printed circuit board including a first terminal mounting passage extending through the first printed circuit board, a second terminal mounting passage, spaced from the first terminal mounting passage, and extending through the first printed circuit board, and a blade passage, located between the first and second terminal mounting passages and extending through the first printed circuit board; and a receptacle terminal having a first terminal support leg, a second terminal support leg, spaced from the first terminal support leg, and a side support arm connected between the first and second terminal support legs, with the first terminal support leg including a first foot portion mounted in the first terminal mounting passage, a first upper end spaced from the first foot portion, a first contact portion located between the first foot portion and the first upper end, and a first top guide portion located between the first upper end and the first contact portion and the second terminal support leg including a second foot portion mounted in the second terminal mounting passage, a second upper end spaced from the second foot portion, a second contact portion located between the second foot portion and the second upper end, and a second top guide portion located between the second upper end and the second contact portion, and with the first contact portion being a distance from the second contact portion that is less than a distance between the first foot portion and the second foot portion and less than a distance between the first upper end and the second upper end, and with the first and second ton guide portions tapering toward each other as the first and second too guide portions extend from the first and second upper ends toward the first and second contact portions;

a second printed circuit board and a first blade mounted on and extending from the second printed circuit board, with the blade having a thickness that is greater than the distance between the first contact portion and the second contact portion, wherein an interference fit is created between the first blade and the first and second contact portions when a portion of the first blade is located between the first and second contact portions, and wherein the first blade extends from the second printed circuit board, between the first and second upper ends, and into contact with the first contact portion and the second contact portion.

2. The terminal blade connection system of claim 1 further including a second receptacle terminal located adjacent to the receptacle terminal and having a third terminal support leg, a fourth terminal support leg, spaced from the third terminal support leg, and second side support arm connected between the third and fourth terminal support legs, with the third terminal support leg including a third foot portion mounted in the first terminal mounting passage, a third upper end spaced from the third foot portion, and a third contact portion located between the third foot portion and the third upper end, and the fourth terminal support leg including a fourth foot portion mounted in the second terminal mounting passage, a fourth upper end spaced from the fourth foot portion, and a fourth contact portion located between the fourth foot portion and the fourth upper end, and with the third contact portion being a distance from the fourth contact portion that is less than a distance between the third foot portion and the fourth foot portion and less than a distance between the third upper end and the fourth upper end.

3. The terminal blade connection system of claim 1 wherein the first printed circuit board further includes a third terminal mounting passage extending through the first printed circuit board, a fourth terminal mounting passage, spaced from the third terminal mounting passage, and extending through the first printed circuit board, a second blade passage, located between the third and fourth terminal mounting passages and extending through the first printed circuit board; and the terminal blade connection system further includes a second receptacle terminal having a third terminal support leg, a fourth terminal support leg, spaced from the first terminal support leg, and second side support arm connected between the third and fourth terminal support legs, with the third terminal support leg including a third foot portion mounted in the third terminal mounting passage, a third upper end spaced from the third foot portion, and a third contact portion located between the third foot portion and the third upper end, and the fourth terminal support leg including a fourth foot portion mounted in the fourth terminal mounting passage, a fourth upper end spaced from the fourth foot portion, and a fourth contact portion located between the fourth foot portion and the fourth upper end, and with the third contact portion being a distance from the fourth contact portion that is less than a distance between the third foot portion and the fourth foot portion and less than a distance between the third upper end and the fourth upper end.

4. The terminal blade connection system of claim 2 wherein the second printed circuit board includes a second blade mounted on and extending therefrom, with the second blade having a thickness that is greater than the distance between the third contact portion and the fourth contact portion, wherein an interference fit is created between the second blade and the third and fourth contact portions when a portion of the second blade is located between the third and fourth contact portions.

5. The terminal blade connection system of claim 1 wherein the first terminal support leg includes a first bottom guide portion located between the first foot and the first contact portion, and the second terminal support leg includes a second bottom guide portion located between the second foot and the second contact portion, with the first and second bottom guide portions tapering toward each other as the first and second bottom guide portions extend from the first and second foot portions toward the first and second contact portions.

6. A terminal blade connection system comprising:

a first printed circuit board including a first terminal mount, a second terminal mount, spaced from the first terminal mount, and a blade passage, located between the first and second terminal mounts and extending through the first printed circuit board;

a receptacle terminal having a first terminal support leg, a second terminal support leg, spaced from the first terminal support leg, and a side support arm connected between the first and second terminal support legs, with the first terminal support leg including a first foot portion mounted to the first terminal mount, a first upper end spaced from the first foot portion, and a first contact portion located between the first foot portion and the first upper end, and the second terminal support leg including a second foot portion mounted to the second terminal mount, a second upper end spaced from the second foot portion, and a second contact portion located between the second foot portion and the second upper end, and with the first contact portion being a distance from the second contact portion that is less than a distance between the first foot portion and the second foot portion and less than a distance between the first upper end and the second upper end; and a second printed circuit board having a first blade mounted on and extending therefrom, with the blade having a thickness that is greater than the distance between the first contact portion and the second contact portion, wherein an interference fit is created between the first blade and the first and second contact portions when a portion of the first blade is located between the first and second contact portions, and wherein the first blade extends from the second printed circuit board, between the first and second upper ends, and into contact with the first contact portion and the second contact portion.

7. The terminal blade connection system of claim 6 wherein the first terminal support leg includes a first top guide portion located between the first upper end and the first contact portion, and the second terminal support leg includes a second top guide portion located between the second upper end and the second contact portion, with the first and second top guide portions tapering toward each other as the first and second top guide portions extend from the first and second upper ends toward the first and second contact portions.

* * * * *